US006079561A

United States Patent [19]

Burkard

[11] Patent Number: 6,079,561

[45] Date of Patent: Jun. 27, 2000

[54] PACKAGING AND DISPLAY APPARATUS

[75] Inventor: Jeff Burkard, Carteret, N.J.

[73] Assignee: Jazz Photo Corp., Carteret, N.J.

[21] Appl. No.: 09/110,844

[22] Filed: Jul. 7, 1998

[51] Int. Cl.[7] ..... B65D 75/34; B65D 75/36

[52] U.S. Cl. ..... 206/461; 206/459.5

[58] Field of Search ..... 206/461–471, 206/457, 459.5; 132/301, 316

[56] References Cited

U.S. PATENT DOCUMENTS

| | | | |
|---|---|---|---|
| Re. 33,191 | 4/1990 | Matney | 206/461 |
| 4,326,546 | 4/1982 | Acker | 206/461 |
| 4,781,289 | 11/1988 | Perkins | 206/461 |

*Primary Examiner*—Jim Foster

*Attorney, Agent, or Firm*—Burns, Doane, Swecker & Mathis, L.L.P.

[57] ABSTRACT

The invention is a packaging and display apparatus generally in the form of a hang cell construction. A backing board has an article mounted to it and the entirety is encased in a transparent material to present the article for display. A further side or end of the article is presented to a purchaser viewing from the front by provision of an angled reflective surface adjacent that side or end presenting the reflected view of that side or end of the article to the purchaser. This allows the hang cell construction to allow the purchaser viewing the front of the display to see that side of the article as well as a reflected view of a further side which may carry features which might otherwise not be apparent.

8 Claims, 2 Drawing Sheets

PACKAGING AND DISPLAY APPARATUS

BACKGROUND TO THE INVENTION

1. Field of the Invention

This invention relates to a packaging apparatus with emphasis on the display of the apparatus when, typically, presented in the form of a hang cell product.

2. Description of the Prior Art

A variety and forms of packaging exists so that products within the packaging may be displayed for sale.

A common form of such packaging is used if the product is to be hung on a hook or similar protrusion. Often a stack of such articles may be provided on a single projection from a wall.

Packages of this type often provide the article against a backing board, typically made of cardboard and printed appropriately. A clear plastic cover may be provided over the article so that the article is clearly visible against the backing board and presented to a purchaser in that manner.

Although a useful form of packaging for presenting at least one view of the article to a purchaser, a purchaser would need to take the package off the hanger on which it is provided or otherwise manipulate the stack of articles on a hanger to try and gain a view of any features of interest on alternative sides of the product. In the case of products where a distinct feature of note is provided on an end or alternative side of the product, it may be desirable to present some image of this other side to a purchaser when they are simultaneously viewing the product from the primary direction in which the product is intended to be viewed.

OBJECT OF THE INVENTION

It is an object of the present invention to provide a packaging and display apparatus which overcomes some of the disadvantages of the prior art or at least provides the public with a useful choice.

In particular, it may be an object of the preferred embodiment to present an indication of features of more than one side of an article to a purchaser when viewing the article within the package from a single direction.

SUMMARY OF THE INVENTION

Accordingly, in a first aspect, the invention consists in a packaging and display apparatus comprising:

a containing portion containing an article for display;

a transparent portion form mg at least a part of said containing portion to allow a view of a first side of the article within the containing portion when viewed from a first direction;

a reflective surface adjacent a second side or end of said article; and said reflective surface being an angle to present a reflected view of at least a portion of said adjacent side or end when viewed from said first direction.

Further aspects of this invention may become apparent to those skilled in the art upon reading the following description:

BRIEF DESCRIPTION OF THE DRAWINGS

Preferred embodiments of the invention will now be described with reference to the following drawings in which.

DETAILED DESCRIPTION OF PREFERRED EMBODIMENT

Figure 1:
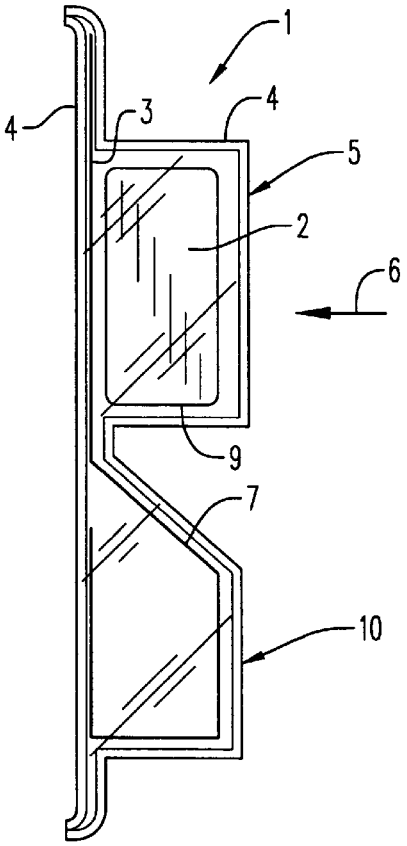
FIG. 1 shows a side elevation of a packaging or display apparatus in accordance with the first embodiment of the invention.

The preferred embodiment will be described with reference to the drawings. This can be seen in FIG. 1, a packaging and display apparatus 1 is provided for the packaging and display of an article 2. The packages provided in the form of a bang cell having an aperture 3 so that the package may be hung on a hook or other projection to present the item for display and sale. Although this is the preferred form of the invention, the invention can be applied to other forms of packaging where the article 2 is displayed in the packaging including normal box construction packaging for display on shelves or similar where at least a portion of the article 2 is viewed from at least a first direction.

In these examples, the construction generally comprises a backing board 3 made from a suitably firm material. Often cardboard is used for these backing boards although other materials may be used. One of the major purposes of the backing board 3 is to carry printing and art work to surround the article 2 and presented for display or provide information. It is for this reason that cardboard or paper or similar is often used. Cardboard may be preferred because of its stiffness.

Generally the backing board 3 and the article 2 are entirely case in a containing material 4. In these embodiments, this is shown as two plastic layers 4 on either side of the backing board 3 to entirely encase the backing board 3 and the article 2. Although the containing materials 4 entirely surround the backing board and article, in other examples, they may comprise a single portion of material simply over the article 2 such that a containing portion 5 is provided in which the article 2 sits.

So that the article 2 may be viewed, at least a portion of the containing portion 5 may be provided in a transparent material to provide a view of at least a portion of the article 2 from a first direction. In these embodiments, the first direction is shown by arrow 6 in the front view of the display apparatus 1 and the article 2 held within. In fact, in this preferred embodiment the entire layers of plastic 4 are provided as clear transparent materials to allow a full view of the backing board 3 and all the printed material on that backing board.

In the case of other packages such as perhaps a box construction, the containing portion 5 may be simply provided with a clear panel in one side of the box.

The purpose of the transparent portion somewhere in the containing portion 5 is to provide a view of at least a first side 8 of the article 2 to contain within the containing portion.

The apparatus as shown in FIG. 1 may provide a reflective surface 7 adjacent a further side or in line of the article 2. This reflective surface 7 is angled so that a reflected view of the end or side 9 or at least a portion of that indoor side is presented to a potential purchaser when viewing the article 2 in a first direction 6. In this manner, a purchaser viewing an article within the packaging or display apparatus or hang cell can gain an impression of features on the side or end 9 which might otherwise not be easily apparent to the potential purchaser.

Again, in this preferred form only, the reflected surface 7 is merely provided by a reflective paint or coating on an angled portion of the backing board 3. It can be seen that the backing board 3 can be folded into a box-like construction 10 adjacent the base and the reflective surface 7 may be provided as an upper portion of that base section 10.

If desired, the base section 10 may be used to hold other items to be sold in conjunction with the article 2.

Figure 2:
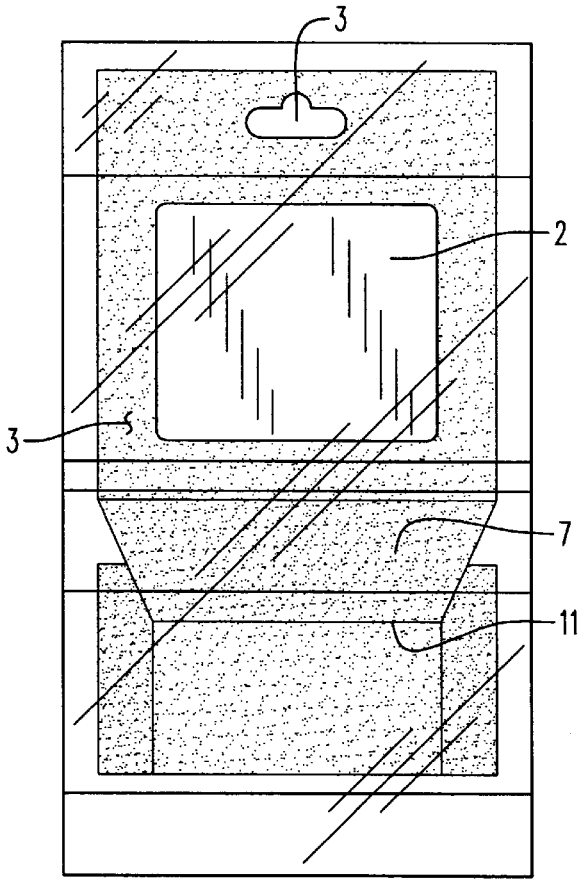
FIG. 2 shows a front elevation of the embodiment of FIG. 1.

As shown in FIG. 2, the angled portion 7 may be taped towards its frontage 11 or otherwise shaped to provide a particular desired appearance to the overall package.

Figure 3:
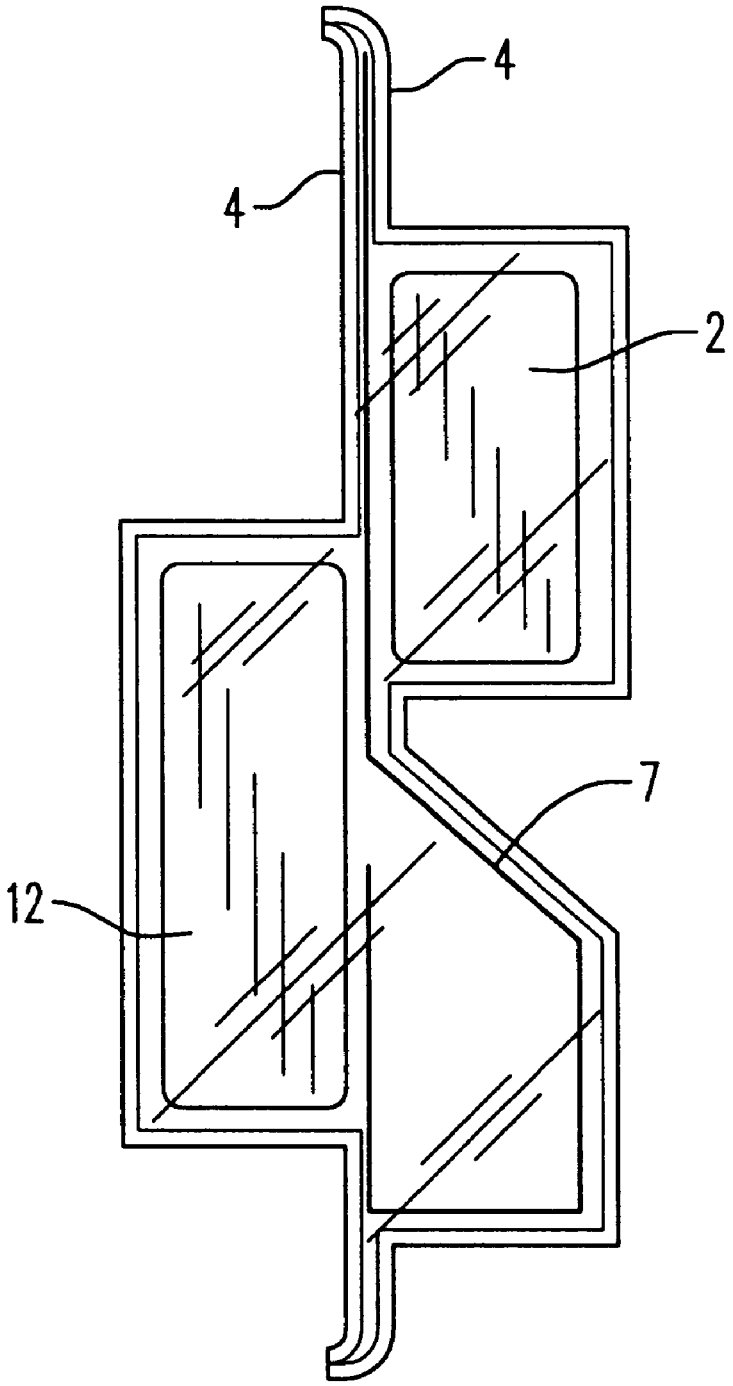
FIG. 3 shows a side elevation of a further embodiment of the apparatus.

A further embodiment of the apparatus is shown in FIG. 3. In this embodiment, a further article 12 is contained at the back of the package which is intended to be sold as part of the overall article being sold. If this additional item 12 need not be displayed to the purchaser in any particular method, it may be provided in the back to hide the item from the initial display to the potential purchaser.

In the embodiment shown, the intended article is a pair of binoculars having tinted lenses. When a packaging in accordance with this preferred embodiment is used, the article 2 in the form of binoculars can be presented in its normal configuration viewable to a user looking in from the direction 6. The tinted lenses at the end in line of the binoculars can be shown reflected in the reflective surface 7.

As shown in FIG. 3, a carry bag or similar form binoculars 2 may be provided in a less prominent position in the overall package.

Thus it can be seen that this invention provides a packaging and display apparatus which allows a potential purchaser viewing from one direction to gain a view of both a first side of the article and also features contained on a further side or end. The features of the further side or end are presented in a reflected angle portion directing a view to the purchaser of those features.

In this particular embodiment, the invention may be provided as a hang cell construction with a backing board being in case in a transparent plastic or similar transparent material cover to contain the article 2 and presented for display. The reflective surface 7 can be provided out of the backing board 3 for simplicity of constriction.

Thus it can be seen that the invention provides a packaging and display apparatus which may provide advantages over those already known.

I claim:

1. A packaging and display apparatus comprising:

a containing portion for containing an article for display;

a backing board portion onto which said article may be mounted forming a part of said containing portion;

a transparent portion forming at least a further part of said containing portion to allow a view of a first side of the article within the containing portion when viewed from a first direction;

a support member having a reflective layer disposed thereon adjacent a second side or end of said article; and said support member and reflective layer forming a reflective surface which is at a non-zero angle to said backing board portion to present a reflected view of at least a portion of said second side or end when viewed from said first direction.

2. A packaging and display apparatus as claimed in claim 1 wherein said containing portion is formed by surrounding an article on said backing board portion with a transparent encasing material.

3. A packaging and display apparatus as claimed in claim 1 wherein said apparatus is provided in the form of a hang cell construction.

4. A packaging and display apparatus as claimed in claim 1 wherein said support member is formed by a second backing board portion.

5. A packaging and display apparatus as claimed in claim 1, wherein said containing portion comprises a first containing portion and said packaging and display apparatus further comprises a second containing portion disposed adjacent to said first containing portion.

6. A packaging and display apparatus as claimed in claim 5, wherein said second containing portion is formed from said transparent portion.

7. A packaging and display apparatus as claimed in claim 6, wherein said support member is disposed in a manner to form the side between said first and second containing portions, in a manner to reflect said article contained by said first containing portion.

8. A packaging and display apparatus as claimed in claim 7, wherein said support member is formed by a second backing board portion.

* * * * *